US009333517B2

(12) United States Patent
Koklu

(10) Patent No.: US 9,333,517 B2
(45) Date of Patent: May 10, 2016

(54) FLUIDIC OSCILLATOR ARRAY FOR SYNCHRONIZED OSCILLATING JET GENERATION

(71) Applicant: U.S.A. as represented by the Administrator of the National Aeronautics and Space Administration, Washington, DC (US)

(72) Inventor: Mehti Koklu, Hampton, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 181 days.

(21) Appl. No.: 13/786,713

(22) Filed: Mar. 6, 2013

(65) Prior Publication Data

US 2015/0238983 A1 Aug. 27, 2015

(51) Int. Cl.
*B05B 1/08* (2006.01)
*F15C 1/22* (2006.01)

(52) U.S. Cl.
CPC .... *B05B 1/08* (2013.01); *F15C 1/22* (2013.01)

(58) Field of Classification Search
CPC ..... B05B 1/08; F15C 1/22
USPC ..... 239/589.1, 555, 589
See application file for complete search history.

(56) References Cited

U.S. PATENT DOCUMENTS 3,158,166 A * 11/1964 Warren ..... 137/835
3,605,778 A * 9/1971 Metzger ..... 137/804
4,185,777 A * 1/1980 Bauer ..... 239/394
4,482,366 A * 11/1984 Camplin et al. ..... 96/426
4,508,267 A 4/1985 Stouffer
4,596,364 A * 6/1986 Bauer ..... 239/589.1
7,128,082 B1 * 10/2006 Cerretelli et al. ..... 137/14
7,293,722 B1 * 11/2007 Srinath et al. ..... 239/589.1

FOREIGN PATENT DOCUMENTS

EP 2554854 A2 2/2013

OTHER PUBLICATIONS

Gad-El-Hak, M., "Flow Control," Applied Mechanics Reviews, Oct. 1989, pp. 261-293, vol. 42, No. 10.

Greenblatt, D. and Wygnanski, I. J., "The control of flow separation by periodic excitation," Progress in Aerospace Sciences, 2000, pp. 487-545, vol. 36, Issue 7.

Magill, J. C. and McManus, K. R., "Exploring the Feasibility of Pulsed Jet Separation Control for Aircraft Configurations," Journal of Aircraft, Jan.-Feb. 2001, pp. 48-56, vol. 38, No. 1.

(Continued)

*Primary Examiner* — Arthur O Hall
*Assistant Examiner* — Juan C Barrera
(74) *Attorney, Agent, or Firm* — Robin W. Edwards

(57) ABSTRACT

A fluidic oscillator array includes a plurality of fluidic-oscillator main flow channels. Each main flow channel has an inlet and an outlet. Each main flow channel has first and second control ports disposed at opposing sides thereof, and has a first and a second feedback ports disposed at opposing sides thereof. The feedback ports are located downstream of the control ports with respect to a direction of a fluid flow through the main flow channel. The system also includes a first fluid accumulator in fluid communication with each first control port and each first feedback port, and a second fluid accumulator in fluid communication with each second control port and each second feedback port.

10 Claims, 6 Drawing Sheets

(56) References Cited

OTHER PUBLICATIONS

Roth, J. R., Sherman, D. M., and Wilkinson, S. P., "Electrohydrodynamic Flow Control With a Glow-Discharge Surface Plasma," AIAA Journal, Jul. 2000, pp. 1166-1172, vol. 38, No. 7.
Enloe, C. L., McLaughlin, T. E., Vandyken, R. D., Kachner, K. D., Jumper, E. J., Corke, T. C., Post, M. and Haddad, O., "Mechanisms and Responses of a Single Dielectric Barrier Plasma Actuator: Geometric Effects," AIAA Journal, Mar. 2004, pp. 595-604, vol. 42, No. 3.
Glezer, A. and Amitay, M., "Synthetic Jets," Annual Review of Fluid Mechanics, 2002, pp. 503-529, vol. 34.
Viets, H., "Flip-Flop Jet Nozzle," AIAA Journal, Oct. 1975, pp. 1375-1379, vol. 13, No. 10.
Beale, R. B. and Lawler, M. T., "Development of a Wall-Attachment Fluidic Oscillator Applied to Volume Flow Metering," 1997, pp. 989-996, vol. 1, Issue Pt. 2.
Wang, H., Beck, S. B. M., Priestman, G. H., and Boucher, R. F., "Fluidic Pressure Pulse Transmitting Flowmeter," Chemical Engineering Research & Design, Transactions of the Institute of Chemical Engineers, May 1997, pp. 381-391, vol. 75, No. A4.
DeSalvo, M., Whalen, E., and Glezer, A., "High-Lift Enhancement using Fluidic Actuation," 48th AIAA Aerospace Sciences Meeting, Orlando, FL: AIAA 2010-863; Jan. 4-7, 2010, pp. 1-17.
Seele, R., Tewes, P., Woszidlo, R., McVeigh, M. A., Lucas, N. J., and Wygnanski, I. J., "Discrete Sweeping Jets as Tools for Improving the Performance of the V-22," Journal of Aircraft, Nov.-Dec. 2009, pp. 2098-2106, vol. 46, No. 6.
Phillips, E., Woszidlo, R., and Wygnanski, I., "The Dynamics of Separation Control on a Rapidly Actuated Flap", AIAA 2010-4246, AIAA 5th Flow Control Conference, Chicago, Illinois, Jun. 28-Jul. 1, 2010, pp. 1-16.
Cerretelli, C., Wuerz, W., and Gharaibah, E., "Unsteady Separation Control on Wind Turbine Blades Using Fluidic Oscillators" AIAA Journal, Jul. 2010, pp. 1302-1311, vol. 48, No. 7.
Gregory, J. W., Gnanamanickam, E. P., Sullivan, J. P., and Reghu, S., "Variable-Frequency Fluidic Oscillator Driven by Piezoelectric Bender," AIAA Journal, Nov. 2009, pp. 2717-2725, vol. 47, No. 11.
Tesar, V., "The Guided Jet Principle," Fluidics Quarterly, vol. 3, No. 4, 1971, pp. 77-99.
Taft, C. K., and Herrick, B. M., "A Proportional Piezoelectric Electro-Pneumatic Servovalve Design," Proceedings of the Joint Automotive Control Conference, The American Automatic Control Council, Charlottesville, Virginia, Jun. 17-19, 1981, Paper No. WA-8A.
Chen, R., and Lucas, G. G., "An Investigation into the Use of Piezo-Fluidic Combined Units as Fuel Injectors for Natural Gas Engines." International Fall Fuels & Lubricants Meeting & Exposition, Oct. 14-17, 1996, pp. 131-142, vol. 1208, Society of Automotive Engineers, Inc.
Chen, R., "Piezo-fluidic Gaseous Fuel MPI System for Natural Gas Fuelled IC Engines," JSME International Journal, Series B (Fluids and Thermal Engineering), 2001, pp. 158-165, vol. 44, No. 1.
Gregory, J. W., Ruotolo, J. C., Byerley, A. R., and McClaughlin, T. E., "Switching Behavior of a Plasma-Fluidic Actuator," 45th AIAA Aerospace Sciences Meeting and Exhibit, AIAA Paper 2007-0785, Reno, NV, Jan. 8-11, 2007, pp. 1-11.
Gokoglu, S. A., Kuczmarski, M. A., Culley, D. E., and Raghu, S., "Numerical Studies of a Fluidic Diverter for Flow control," AIAA-2009-4012, 39th AIAA Fluid Dynamics Conference, San Antonio, TX, Jun. 22-25, 2009, pp. 1-14.
Culley, D. E., "Variable Frequency Diverter Actuation for Flow Control," 3rd AIAA Flow Control Conference, AIAA Paper 2006-3034, San Francisco, California, Jun. 5-8, 2006, pp. 1-12.
Gokoglu, S. A., Kuczmarski, M. A., Culley D. E., and Raghu, S., "Numerical Studies of an Array of Fluidic Diverter Actuators for Flow Control." 41st AIAA Fluid Dynamics Conference and Exhibit, AIAA 2011-3100, Honolulu, Hawaii, Jun. 27-30, 2011, pp. 1-11.
Gokoglu, S. A., Kucamarski, M. A., Culley, D. E., and Raghu, S., "Numerical Studies of a Fluidic Diverter for Flow Control," NASA/TM-2009-216088, Dec. 2009.
Taft, C. K., and Herrick, B. M., "A Proportional Piezoelectric Electro-Fluidic Pneumatic Valve Design," Journal of Dynamic Systems, Measurement and Control, vol. 103, No. 4, 1981, pp. 361-365.

* cited by examiner

FLUIDIC OSCILLATOR ARRAY FOR SYNCHRONIZED OSCILLATING JET GENERATION

STATEMENT REGARDING FEDERALLY SPONSORED RESEARCH OR DEVELOPMENT

This invention was made by an employee of the United States Government and may be manufactured and used by or for the Government of the United States of America for governmental purposes without the payment of any royalties thereon or therefor.

CROSS-REFERENCE TO RELATED PATENT APPLICATION

This application is related to co-pending U.S. patent application Ser. No. 13/786,608, titled "Fluidic Oscillator Having Decoupled Frequency and Amplitude Control," filed on the same day as this application.

BACKGROUND OF THE INVENTION

1. Field of the Invention

This invention relates to fluidic oscillators. More specifically, the invention is a fluidic oscillator array that synchronizes the oscillations of the array's output jets.

2. Description of the Related Art

In the 1900s, fluidic oscillators were developed for use as logical function operators. More recently, fluidic oscillators have been proposed for use as active flow control devices where an oscillator's jet output is used to control a fluid flow (e.g., gas or liquid). FIGS. 1A-1C schematically illustrate the basic operating principles of a fluidic oscillator. Briefly, fluid flow 100 enters a fluidic oscillator 10 at its input 10A and attaches to either sidewall 12 or 14 (e.g., right sidewall 14 in the illustrated example) due to the Coanda effect as shown in FIG. 1A. A backflow 102 develops in a right hand side feedback loop 18. Backflow 102 causes fluid flow 100 to detach from right sidewall 14 (FIG. 1B) and attach to left sidewall 12 (FIG. 1C). When fluid flow 100 attaches to left sidewall 12, a backflow 104 develops in left hand side feedback loop 16 which will force fluid flow 100 to switch back to its initial state shown in FIG. 1A. As a result of this activity, fluid flow 100 oscillates/sweeps back and forth at the output 10B of oscillator 10.

In order to achieve relatively large scale active flow control, a number of fluidic oscillators (such as the one described above) can be arranged such that their output jets are arrayed in an area requiring flow control. One drawback associated with arrays of fluidic oscillators is that each fluidic oscillator output jet will oscillate independently of other output jets. Therefore, the resulting array output tends to be random in nature. While this result can be preferable for mixing applications, it does not provide the result predictability needed for efficient active flow control.

BRIEF SUMMARY OF THE INVENTION

Accordingly, it is an object of the present invention to provide a fluidic oscillator array.

Another object of the present invention is to provide a fluidic oscillator array whose output jets oscillate in a synchronized fashion.

Still another object of the present invention is to provide an approach that synchronizes oscillating jets without using moving parts and/or electromechanical components.

Other objects and advantages of the present invention will become more obvious hereinafter in the specification and drawings.

In accordance with the present invention, a fluidic oscillator array includes a plurality of fluidic-oscillator main flow channels. Each main flow channel has an inlet and an outlet wherein a fluid flow is adapted to enter at the inlet and exit at the outlet. Each main flow channel has a first control port and a second control port disposed at opposing sides thereof, and has a first feedback port and a second feedback port disposed at opposing sides thereof. The first feedback port and second feedback port are located downstream of the first control port and second control port, respectively, with respect to a direction of the fluid flow. The system also includes a first fluid accumulator in fluid communication with each first control port and each first feedback port, and a second fluid accumulator in fluid communication with each second control port and each second feedback port.

DETAILED DESCRIPTION OF THE INVENTION

Figures 1A, 1B, 1C:
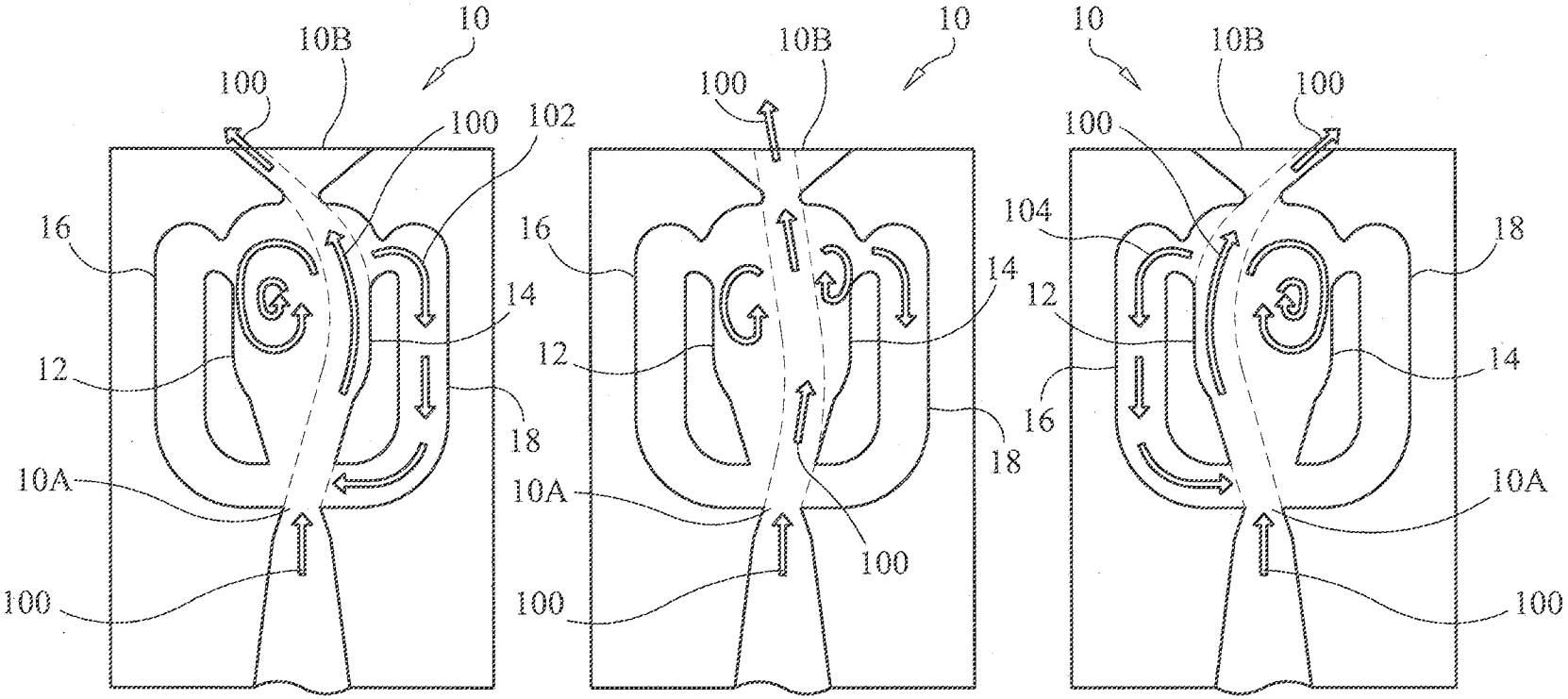
FIG. 1A PRIOR ART
FIG. 1B PRIOR ART
FIG. 1C PRIOR ART
FIGS. 1A-1C schematically illustrate the operating principles of a fluidic oscillator in accordance with the prior art.
Figure 2:
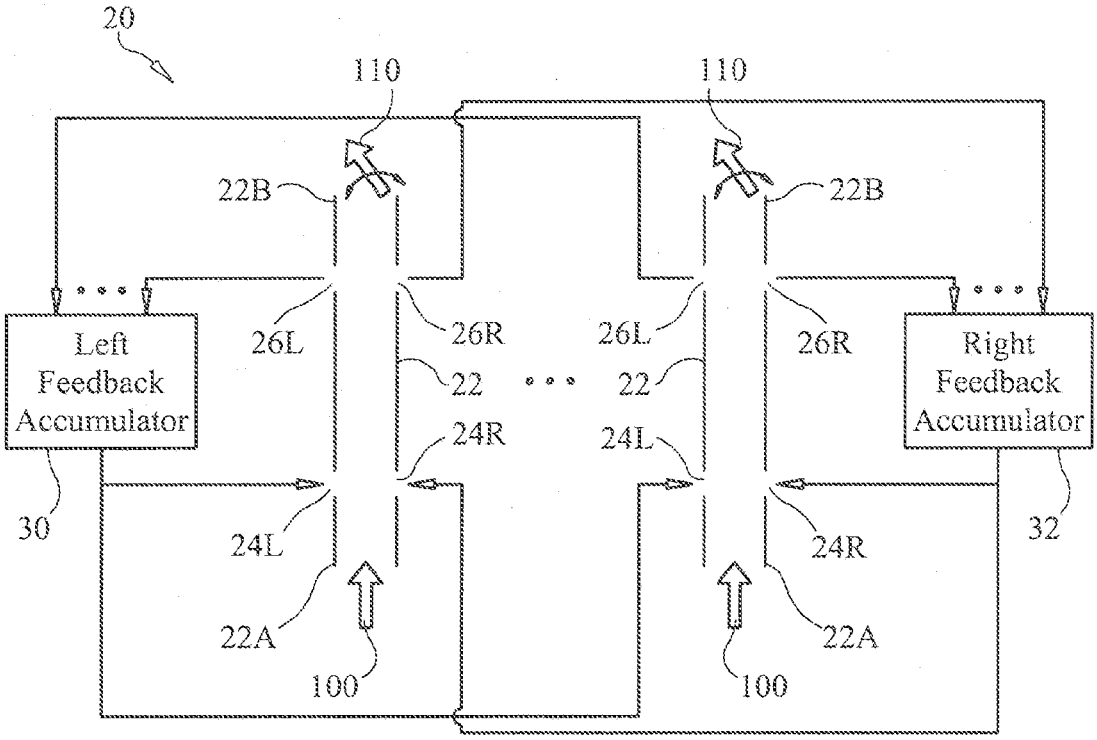
FIG. 2 is a schematic illustration of a fluidic oscillator array that generates synchronized oscillating jets in accordance with an embodiment of the present invention.

Referring again to the drawings and more specifically to FIG. 2, a fluidic oscillator array for generating synchronized oscillating jets in accordance with an embodiment of the present invention is illustrated schematically and is referenced generally by numeral 20. Array 20 includes at least two main flow channels 22 configured as the main flow channel of a fluidic oscillator. That is, each main flow channel 22 has an inlet 22A for receiving a fluid flow 100, an outlet 22B through which the fluid flow will exit as an oscillating jet 110, opposing control polls 24L/24R and opposing feedback ports 26L/26R. The feedback ports 26L/26R are located downstream from control ports 24L/24R with respect to the direction of fluid flow 100. The particular shape/configuration of each main flow channel 22, inlet 22A, and outlet 22B are not limitations of the present invention.

In the illustrated embodiment, each (left side) feedback port 26L in array 20 is fluidically coupled to a first feedback accumulator (e.g., enclosed chamber) 30, while each (right side) feedback port 26R in array 20 is fluidically coupled to a second feedback accumulator (e.g., enclosed chamber) 32. Feedback accumulator 30 is fluidically coupled to each (left side) control port 24L in array 20. Similarly, feedback accumulator 32 is fluidically coupled to each (right side) control port 24R in array 20. By virtue of this construction, as fluid flow 100 moves through main flow channel 22, the backflow entering each (left side) feedback port 24L is collected in a single accumulator site before being supplied to the (left side) control ports 26L. Similarly, the backflow entering each (right side) feedback port 24R is collected in a single accumulator site before being supplied to the (right side) control ports 26R. As a result, the sweeping and oscillating jets 110 at outlets 22B are synchronized in terms of the jets' flow direction at outlets 22B.

Figure 3:
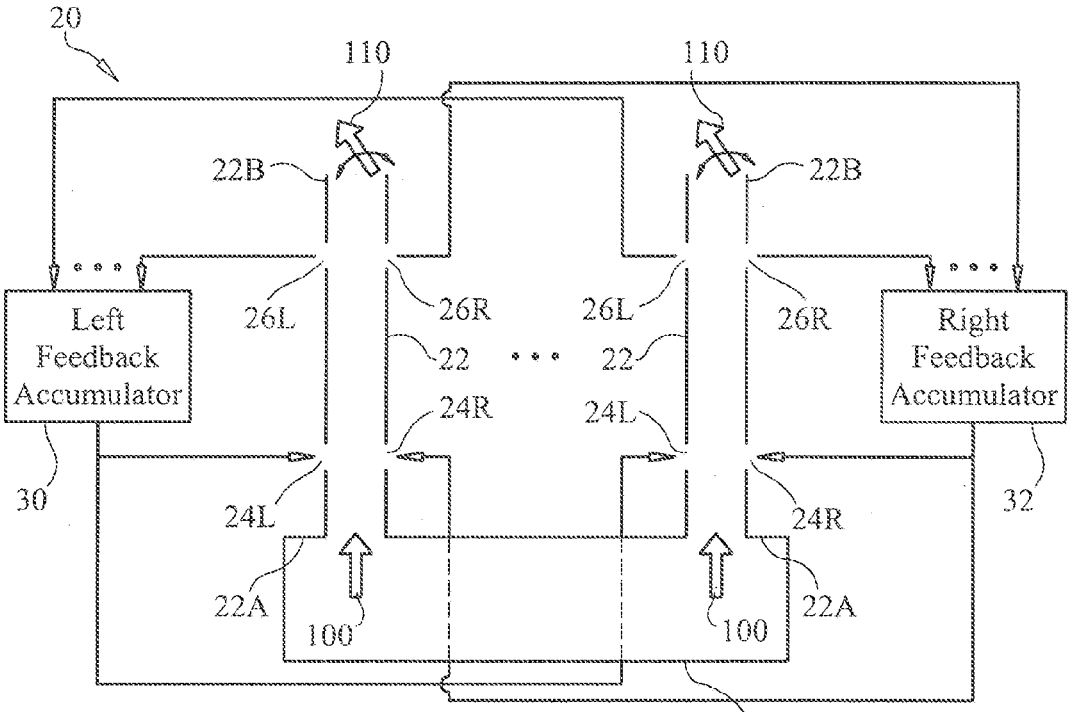
FIG. 3 is a schematic illustration of a fluidic oscillator array utilizing a common plenum in accordance with an embodiment of the present invention.
Figure 4:
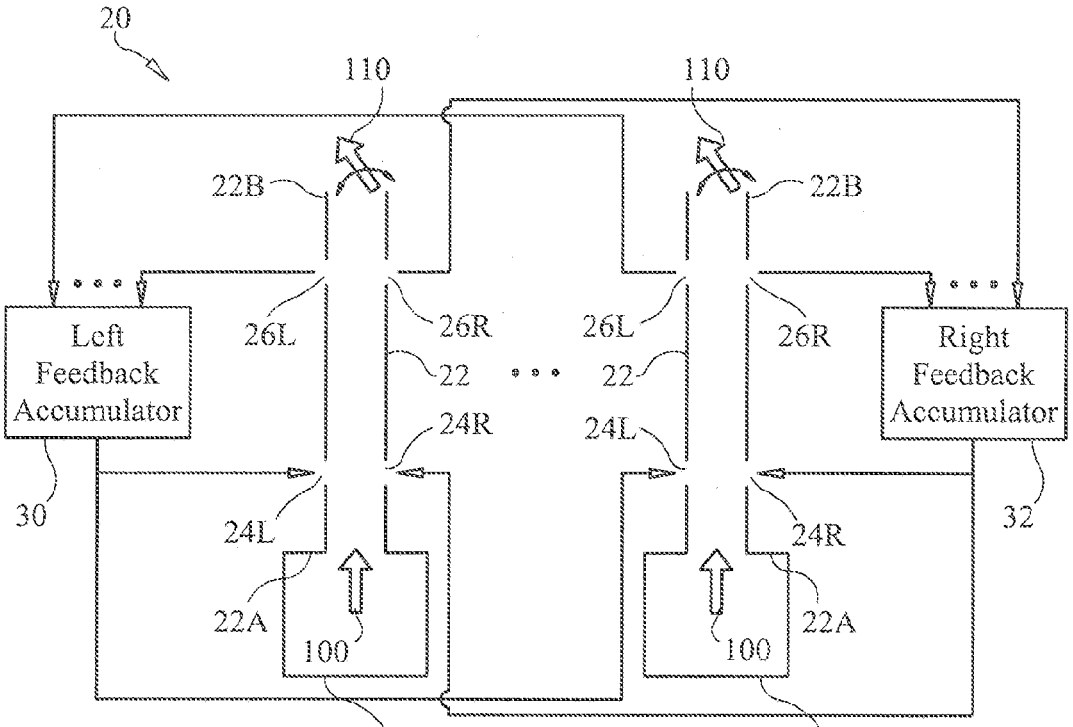
FIG. 4 is a schematic illustration of a fluidic oscillator utilizing a separate plenum for each of the array's oscillators in accordance with another embodiment of the present invention.

Fluid flow 100 can be individually supplied to the inlet 22A of each main flow channel 22. Fluid flow 100 could also be supplied to a common plenum 40 (FIG. 3) fluidically coupled to all inlets 22A. Still further, fluid flow 10 could be supplied to a separate/dedicated plenum 42 (FIG. 4) associated and coupled to a particular one of inlets 22A. The common plenum (FIG. 3) embodiment will produce the same oscillation frequency and velocity at each outlet of the array, while the separate plenum (FIG. 4) embodiment will produce the same oscillation frequency at each outlet of the array but can be used to generate different velocities at the array's outlets. Accordingly, it is to be understood that the method and structure of supplying fluid flow 100 to main flow channels 22 are not limitations of the present invention.

Figure 5:
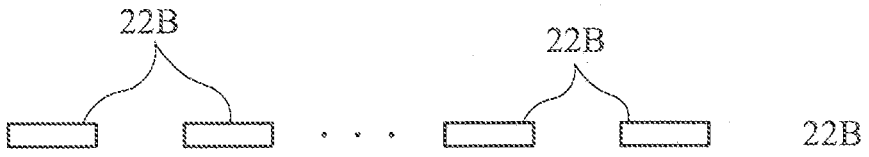
FIG. 5 is a head-on view of a linear arrangement of outlet jets for a fluidic oscillator array in accordance with an embodiment of the present invention.
Figure 6:
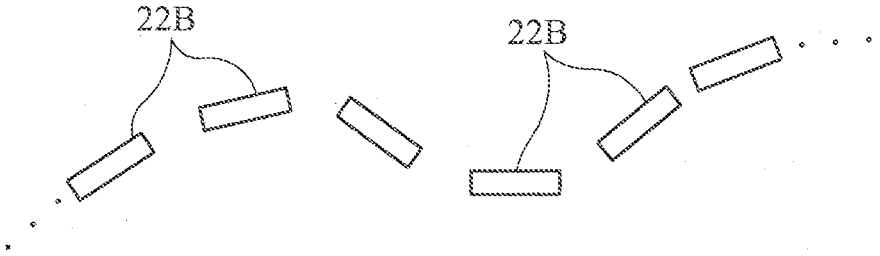
FIG. 6 is a head-on view of a nonlinear arrangement of outlet jets for a fluidic oscillator array in accordance with another embodiment of the present invention.
Figure 7:
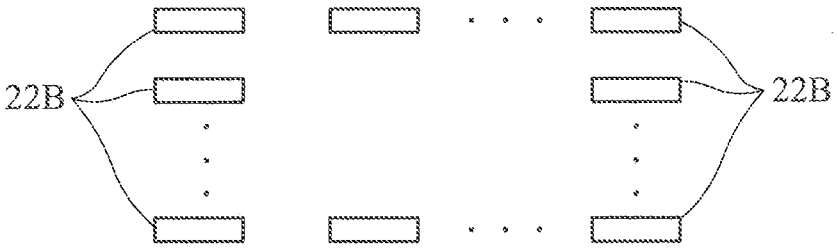
FIG. 7 is a head-on view of a two-dimensional arrangement of outlet jets for a fluidic oscillator array in accordance with another embodiment of the present invention.
Figure 8:
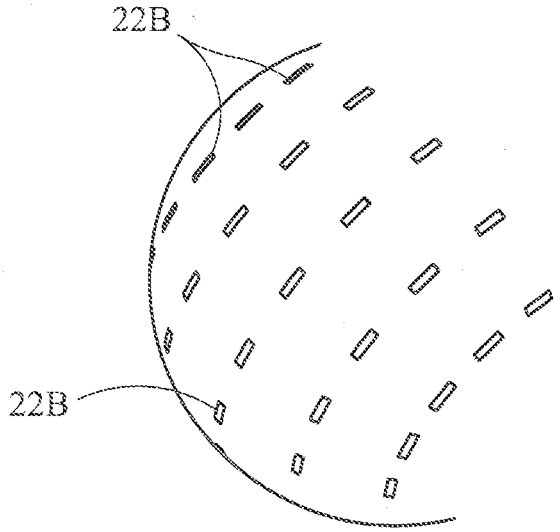
FIG. 8 is a perspective view of a three-dimensional arrangement of outlet jets for a fluidic oscillator array in accordance with another embodiment of the present invention.

Arrays constructed in accordance with the present invention can arrange outlets 22B in a variety of geometric configurations without departing from the scope of the present invention. For example, outlets 22B could be arranged linearly (FIG. 5), nonlinearly (FIG. 6), two-dimensionally (FIG. 7), or three dimensionally (FIG. 8) in order to satisfy the requirements of a particular application.

Figure 9:
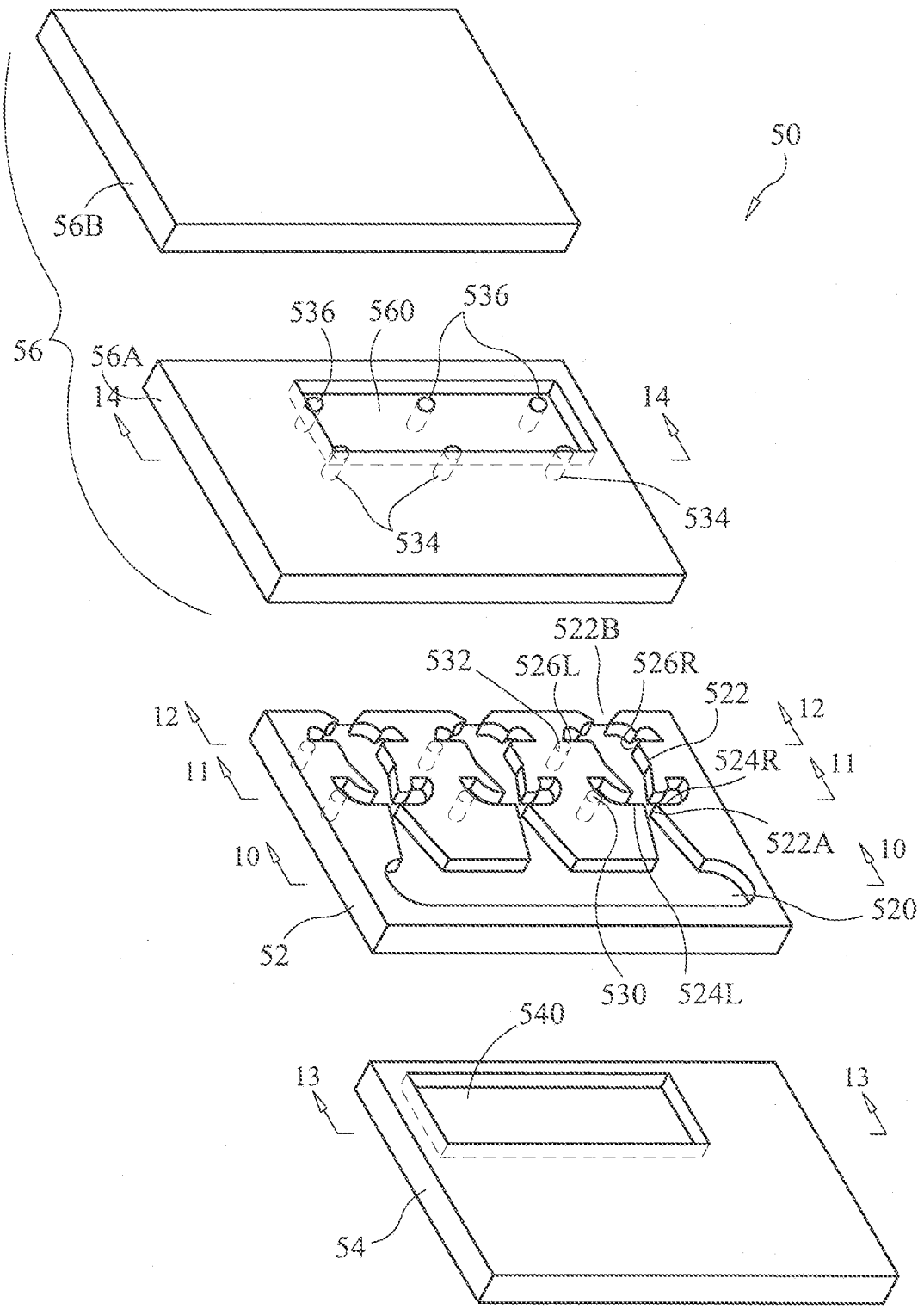
FIG. 9 is an exploded perspective view of a multi-layer fluidic oscillator array in accordance with an embodiment of the present invention.

A variety of approaches can be used to construct an array's main flow channels and accumulators. By way of example, a layered construction of a fluidic oscillator array 50 is presented in an exploded view in FIG. 9. Array 50 includes a main flow channel layer 52 disposed between a left side accumulator layer 54, and a right side accumulator layer 56. Array 50 is a three-outlet array, but could be constructed to provide two or more than three outlets, in general, fluidic oscillator array 50 is predicated on a conventional fluidic oscillator design with the conventional feedback loops interrupted and then combined as will be described further below.

Figure 10:
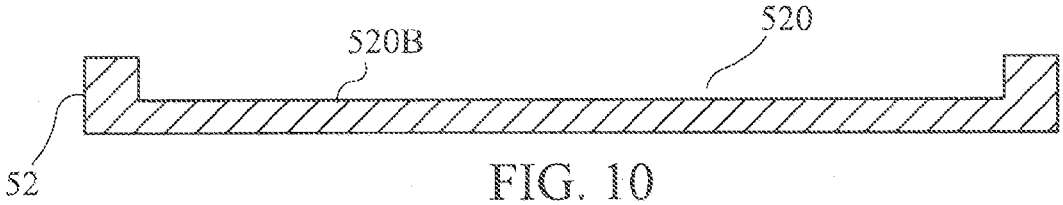
FIG. 10 is a cross-sectional view of the main flow channel layer taken along line 10-10 in FIG. 9.
Figure 11:
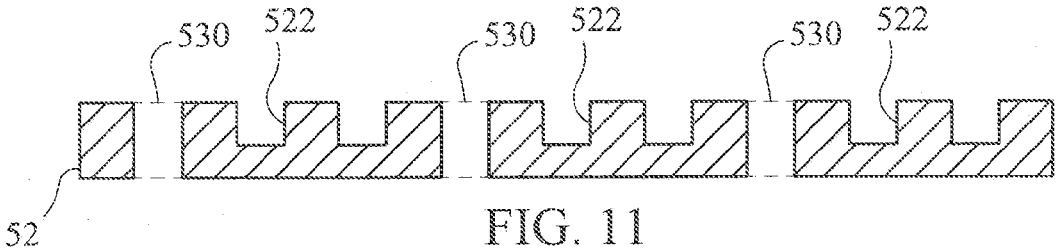
FIG. 11 is a cross-sectional view of the main flow channel layer taken along line 11-11 in FIG. 9.
Figure 12:
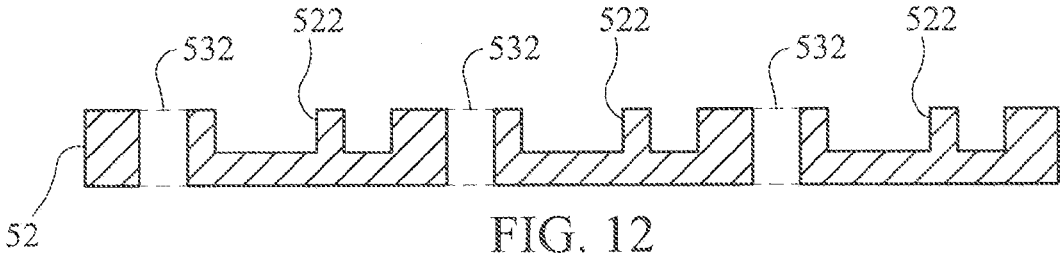
FIG. 12 is a cross-sectional view of the main flow channel layer taken along line 12-12 in FIG. 9.

Main flow channel layer 52 is tray-like in construction with a common plenum 520 and three main flow channels 522 being formed/defined in a partial thickness of layer 52. This is illustrated in the isolated cross-sectional view of layer 52 shown in FIG. 10 where the base 520B of plenum 520 is defined within layer 52. Each main flow channel has an inlet 522A in fluid communication with plenum 520 and has an outlet 522B through which a fluid flow will exit. Each main flow channel 522 has a left side control port 524L, a right side control port 524R, a left side feedback port 526L, and a right side feedback port 526R. For clarity of illustration, these ports are only referenced for one main flow channel 522. The purpose of the feedback and control ports is analogous to the description provided above for FIG. 2. Each left side feedback port and control port of a main channel is in fluid communication with a hole in layer 52. More specifically, each left side control port 524L is adjacent a hole 530 in layer 52 (FIG. 11), while each left side feedback port 526L is adjacent a hole 532 in layer 52 (FIG. 12).

Figure 13:
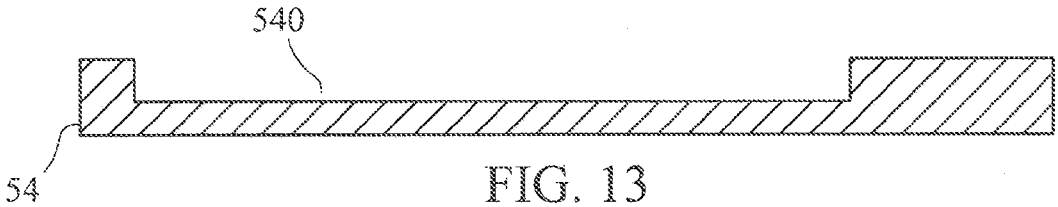
FIG. 13 is a cross-sectional view of the left side accumulator layer taken along line 13-13 in FIG. 9.

A left side accumulator is formed when layer 54 is coupled to the underside of layer 52 as illustrated. Layer 54 is also tray-like in construction with an accumulator region 540 being formed in a partial thickness of layer 54 as illustrated in FIG. 13. Region 540 is sized and positioned to define a contiguous volume that is in fluid communication with all of holes 530 and 532 when layer 54 is coupled to layer 52. In this way, accumulator region 540 serves as a single collector for fluid exiting left side feedback ports 526L and as a single source for fluid supplied back to each main channel 522 via left side control ports 524L.

Figure 14:
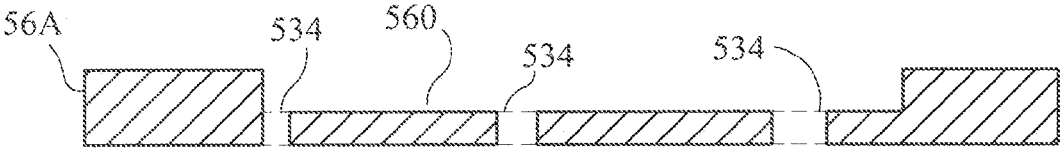
FIG. 14 is a cross sectional view of the right side accumulator layer taken along line 14-14 in FIG. 9.

In a similar fashion, a right side accumulator is formed when layer 56 is coupled to the top side of layer 52 as illustrated. Layer 56 is defined by a formed part 56A and a solid top cover 56B. Formed part 56A is tray-like in construction with an accumulator region 560 being formed in a part al thickness thereof as illustrated in FIG. 14. Holes 534 and 536 are provided through formed part 56A with holes 534 providing fluid communication between accumulator region 560 and each right side control port 524R, and with holes 536 providing fluid communication between accumulator region 560 and each right side feedback port 526R. In this way, accumulator region 560 serves as a single collector for fluid exiting right side feedback ports 526R and as a single source for fluid supplied back to each main flow channel 522 via right side control ports 524R.

The coupling of all left side control ports to the left side accumulator and all right side control ports to the right side accumulator produces a homogeneous sweeping jet output, i.e., all of the output jets move left/right at the same time. However, it is to be understood that the present invention is not limited to the generation of such homogeneous synchronization of weeping jets. That is, it is also possible to configure the present invention to produce heterogeneous synchronization by coupling some of the left side control ports to the right side accumulator and some of the right side control ports to the left side accumulator. For example, in the three-oscillator array used for illustration herein, the control ports of the first and third oscillators could retain the left/right coupling, as described above, while the second (middle) oscillator has its right side control port coupled to the left side accumulator and its left side control port coupled to the right side accumulator. In this way, as the output jets from the first and third oscillators are sweeping to the left, the output jet from the second oscillator would be sweeping to the right, i.e., output jet from the second oscillator would be 180° out-of-phase with respect to the output jets from the first and third oscillators. However, the outputs would remain predictable and synchronous. Other patterns of control port coupling could be used without departing from the scope of the present invention.

The advantages of the present invention are numerous. An array of fluidic oscillators can provide a synchronized oscillating (e.g., sweeping, out-of phase, etc.) output through the use of feedback accumulators. Synchronization is achieved simply and without requiring the addition of any moving parts. The principles of the present invention can be applied to any fluidic oscillator design that is designed to use feedback loops to control output oscillations.

Although the invention has been described relative to specific embodiments thereof, there are numerous variations and modifications that will be readily apparent to those skilled in the art in light of the above teachings. It is therefore to be understood that within the scope of the appended claims, the invention may be practiced other than as specifically described.

What is claimed as new and desired to be secured by Letters Patent of the United States is:

1. A fluidic oscillator array, comprising:

a plurality of fluidic-oscillator main flow channels, each of said main flow channels having an inlet and a single outlet wherein a fluid flow is adapted to enter at said inlet and exit at said outlet, each of said main flow channels having a first control port and a second control port disposed at opposing sides thereof, and each of said main flow channels having a first feedback port and a second feedback port disposed at opposing sides thereof wherein all feedback and control ports on the first side of the main flow channels fluidically communicate with a first feedback accumulator, and all feedback and control ports on a second side of the main flow channels fluidically communicate with a second feedback accumulator;

and wherein said first feedback port and said second feedback port are located downstream of said first control port and said second control port, respectively, with respect to a direction of said fluid flow;

and wherein the first feedback accumulator is in fluid communication with each said first control port and each said first feedback port; and and wherein the second feedback accumulator is in fluid communication with each said second control port and each said second feedback port.

2. A fluidic oscillator array as in claim 1, further comprising a common plenum in fluid communication with each said inlet.

3. A fluidic oscillator array as in claim 1, further comprising a plurality of plenums in correspondence with said plurality of main flow channels wherein each of said plenums is in fluid communication with a unique one said inlet.

4. A fluidic oscillator array as in claim 1, wherein each said outlet is one of a nonlinear array of outlets.

5. A fluidic oscillator array as in claim 1, wherein each said outlet is one of a two-dimensional array of outlets.

6. A fluidic oscillator array as in claim 1, wherein each said outlet is one of a three-dimensional array of outlets.

7. A fluidic oscillator array as in claim 1, wherein said array comprises a layered construction, and wherein said main flow channels are disposed on a first layer of said layered construction, said first feedback accumulator is disposed on a second layer of said layered construction, and said second feedback accumulator is disposed on a third layer of said layered construction.

8. A fluidic oscillator array as in claim 1, wherein each said outlet is one of a linear array of outlets.

9. A fluidic oscillator array comprising:

a plurality of fluidic-oscillator main flow channels, each of said main flow channels having an inlet and an outlet wherein a fluid flow is adapted to enter at said inlet and exit at said outlet, each of said main flow channels having a first control port and a second control port disposed at opposing sides thereof, and each of said main flow channels having a first feedback port and a second feedback port disposed at opposing sides thereof wherein said first feedback port and said second feedback port are located downstream of said first control port and said second control port, respectively, with respect to a direction of said fluid flow;

a first fluid accumulator in fluid communication with each said first control port and each said first feedback port; and a second fluid accumulator in fluid communication with each said second control port and each said second feedback port, wherein said array comprises a layered construction, and wherein said main flow channels are disposed on a first layer of said layered construction, said first fluid accumulator is disposed on a second layer of said layered construction, and said second fluid accumulator is disposed on a third layer of said layered construction.

10. A fluidic oscillator array as in claim 9, wherein each said outlet is one of a linear array of outlets.

* * * * *